US006302286B1

(12) United States Patent
Witherspoon

(10) Patent No.: US 6,302,286 B1
(45) Date of Patent: Oct. 16, 2001

(54) BABY BOTTLE NIPPLE COVER

(76) Inventor: Ingrid Witherspoon, 5533 Allemong Dr., Matteson, IL (US) 60443

( * ) Notice: Subject to any disclaimer, the term of this patent is extended or adjusted under 35 U.S.C. 154(b) by 0 days.

(21) Appl. No.: 09/612,712

(22) Filed: Jul. 10, 2000

(51) Int. Cl.[7] ..... A61J 9/08; B65D 23/12
(52) U.S. Cl. ..... 215/11.6; 215/11.1; 215/306
(58) Field of Search ..... 215/11.1, 11.6, 215/306

(56) References Cited

U.S. PATENT DOCUMENTS

| | | | | |
|---|---|---|---|---|
| 2,613,671 | | 10/1952 | Bonin . | |
| 2,892,559 | | 6/1959 | Raiche . | |
| 2,959,314 | | 11/1960 | Sanchez . | |
| 3,407,956 | * | 10/1968 | Linkletter et al. | 215/306 X |
| 4,394,918 | | 7/1983 | Grussen | 215/252 X |
| 4,564,114 | | 1/1986 | Cole | 215/306 X |
| 4,815,615 | | 3/1989 | Phalphongphanich | 215/11.1 |
| 5,008,066 | | 4/1991 | Mueller | 215/306 X |
| 5,090,583 | * | 2/1992 | Hoffman et al. | 215/306 X |
| 5,150,801 | * | 9/1992 | Held | 215/11.6 |
| 5,361,918 | * | 11/1994 | Mason | 215/11.6 X |
| 5,395,006 | | 3/1995 | Verma | 215/306 X |
| 5,653,353 | * | 8/1997 | Otto et al. | 215/11.6 X |
| 5,725,115 | | 3/1998 | Bosl et al. | 215/306 X |
| 5,725,121 | | 3/1998 | Gianpaolo | 215/306 X |
| 5,791,503 | | 8/1998 | Lyons | 215/11.1 X |

FOREIGN PATENT DOCUMENTS

| | | | | |
|---|---|---|---|---|
| 384615 | * | 4/1908 | (FR) | 215/11.1 |

* cited by examiner

*Primary Examiner*—Sue A. Weaver
(74) *Attorney, Agent, or Firm*—Michael R. McKenna

(57) ABSTRACT

An improved baby bottle nipple cover with a cap retainer that keeps the cap in proximity to the opening when not covering the nipple and that leaves the the collar free to sealingly secure the nipple. The nipple cover is easily transferable from one baby bottle to another.

18 Claims, 2 Drawing Sheets

BABY BOTTLE NIPPLE COVER

BACKGROUND OF THE INVENTION

This invention relates to an improved baby bottle nipple cover for use with a baby bottle that has a collar, an opening circumscribed by a rim, an exterior surface of revolution adjacent to the rim, a shoulder extending radially outward from the exterior surface of revolution, means for engaging the collar to the exterior surface of revolution, and a nipple with a disk-shaped base that can be sealingly secured to the opening when the base is snugly disposed between the rim and the collar. The improvement comprises a cap that is suitably sized to extend over the nipple, and means for retaining the cap in proximity to the opening while leaving the collar free for sealingly securing the base when the cap is removed from extending over the nipple.

It is used with a baby bottle having an opening and a nipple that is sealingly securable to the opening by a collar. The means for retaining comprises a yoke disposed between the collar and the shoulder. The cap is suitably sized to extend over the nipple, and the means for retaining is independent of tethering said cap to the collar. The means for retaining the cap leaves the collar free to sealingly secure the nipple.

One of the principle objects of the invention is to provide a detachable nipple cover that can be conveniently adapted for most baby bottles. It provides, among other things, a thin ring having a plurality of inwardly directed fins which flex to fit over a variety of baby bottle necks of varying diameter and yet provides for appropriate retention when secured by the baby bottle collar.

The baby bottle nipple cover of the present invention is reusable and can be reattached after removal for feeding. The cap remains reversibly engaged to the bottle. As illustrated in the drawing, the nipple cover of this invention may be used with a variety of baby bottle configurations. The nipple cap is removable. A principal object of the present invention is its adaptability to numerous bottle configurations. It also advantageously adapts to bottles of varying diameter. Moreover, it is easily transferable from one bottle to another, even where those bottles are of different size and/or configuration.

The improved baby bottle nipple cover of this invention comprises a baby bottle cap retainer, with means for retaining the cap proximate to the baby bottle, that is disposed on the neck of the bottle between the base of the threaded neck of the bottle and a nipple collar without interfering with the sealing position of the nipple collar on the bottle neck. Preferably, the means for retaining the cap comprises a thin washer having an outer peripheral edge with a tethering means connecting said outer peripheral edge to the cap. This improved baby bottle nipple cover is preferably used with a baby bottle having an opening and a nipple that is sealingly securable to the opening by a collar.

The improved baby bottle nipple cover of this invention is for use with a baby bottle that has a collar, an opening circumscribed by a rim, an exterior surface of revolution adjacent to the rim, a shoulder extending radially outward from the exterior surface of revolution, means for engaging the collar to the exterior surface of revolution, and a nipple with a disk-shaped base that can be sealingly secured to the opening when the base is snugly disposed between the rim and the collar. The improvement taught by this invention comprises a cap that is suitably sized to extend over the nipple, and means for retaining the cap in proximity to the opening while leaving the collar free for sealingly securing the base when the cap is removed from extending over the nipple. The means for retaining comprises a yoke disposed between the collar and the shoulder.

Alternative technology is available in the form of U.S. Pat. No. 5,725,115 issued to Bosl et.al. in 1998 for a closure cap with tether that is attached to a retainer ring, see references #5 (cap) and #39 (ring) of the drawing. The principal disadvantage of such a device is its one time use. The instant invention operates independent of rupture mechanisms, such as those described in U.S. Pat. No. 5,725,115. The nipple cap of the instant invention has a replaceable, reusable cap.

Another U.S. Pat., No. 5,791,503 was issued to Lyons in 1998 for a nursing bottle with anti-air ingestion valve to prevent excessive air swallowing. This invention also provides a removable and/or replaceable valve and teaches a common bottle with a mouth (opening), a cap and a common nipple with an aperture at the end of the extrusion of milk by the action of the infant, sealably retained nipple and the cap is a disk with a flexible valve member which acts as a one-way partially sealed check valve allowing the liquid to flow in one direction while the infant is in the feeding position.

U.S. Pat. No. 4,815,615 teaches an infant feeding system with a detached nipple cover. This conventional baby bottle system is necessarily transportable to accommodate the needs of the parent to move the baby to different locations. The principal disadvantage of such a device is that its baby bottle cap has no retaining means and thus is easily lost or misplaced once removed for feeding.

Another disadvantage to all of the foregoing devices is that they provide for attachment, if any, only to one bottle or neck configuration.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

ADVANTAGES OF THIS INVENTION

Unlike the foregoing devices which teach structures that either do not attach to the bottle so that once the cap is removed it is subject to being lost, or if attached, can not readily be reused or transferred from bottle to bottle, particularly when the bottles have different configurations. To alleviate this problem, and others which will become apparent from the disclosure which follows, the present invention conveniently provides a removable nipple cover that remains attached. It can also conveniently adapt for most baby bottles. It provides, among other things, a thin ring having a plurality of inwardly directed fins which flex to fit over a variety of baby bottle necks of varying diameter and yet provides for appropriate retention when secured by the baby bottle collar.

The baby bottle nipple cover of the present invention is reusable and can be reversibly disposed to cover the nipple after removal for feeding. The cap remains engaged to the bottle. As illustrated in the drawing, the nipple cover of this invention may be used with a variety of baby bottle configurations. The nipple cap is removable and can be sterilized separately.

A principal advantage of the present invention is its adaptability to numerous bottle configurations. It advantageously adapts to bottles of varying diameter. Moreover, it is easily transferable from one bottle to another, even where those bottles are of different size and/or configuration.

Still other advantages will be apparent from the disclosure that follows.

SUMMARY OF THE INVENTION

The invention relates to an improved baby bottle nipple cover. It is used with a baby bottle having an opening and a nipple that is sealingly securable to the opening by a collar. The improvement comprises a cap that is suitably sized to extend over the nipple, and means for retaining the cap in proximity to the opening when the cap is removed from extending over the nipple independent of tethering said cap to the collar. The means for retaining the cap leaves the collar free to sealingly secure the nipple.

The improved baby bottle nipple cover of this invention is for use with a baby bottle that has a collar, an opening circumscribed by a rim, an exterior surface of revolution adjacent to the rim, a shoulder extending radially outward from the exterior surface of revolution, means for engaging the collar to the exterior surface of revolution, and a nipple with a disk-shaped base that can be sealingly secured to the opening when the base is snugly disposed between the rim and the collar. The improvement disclosed herein comprises a cap that is suitably sized to extend over the nipple, and means for retaining the cap in proximity to the opening while leaving the collar free for sealingly securing the base when the cap is removed from extending over the nipple. The means for retaining comprises a yoke disposed between the collar and the shoulder.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 1:
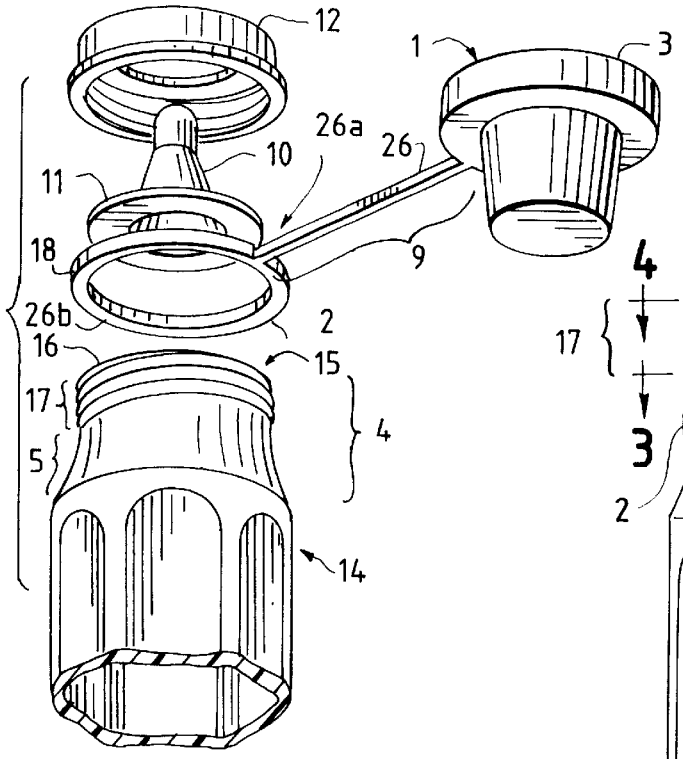
FIG. 1 is an exploded perspective view of the improved baby bottle nipple cover of the present invention showing the nipple cover, nipple and collar exploded away from the baby bottle.
Figure 2:
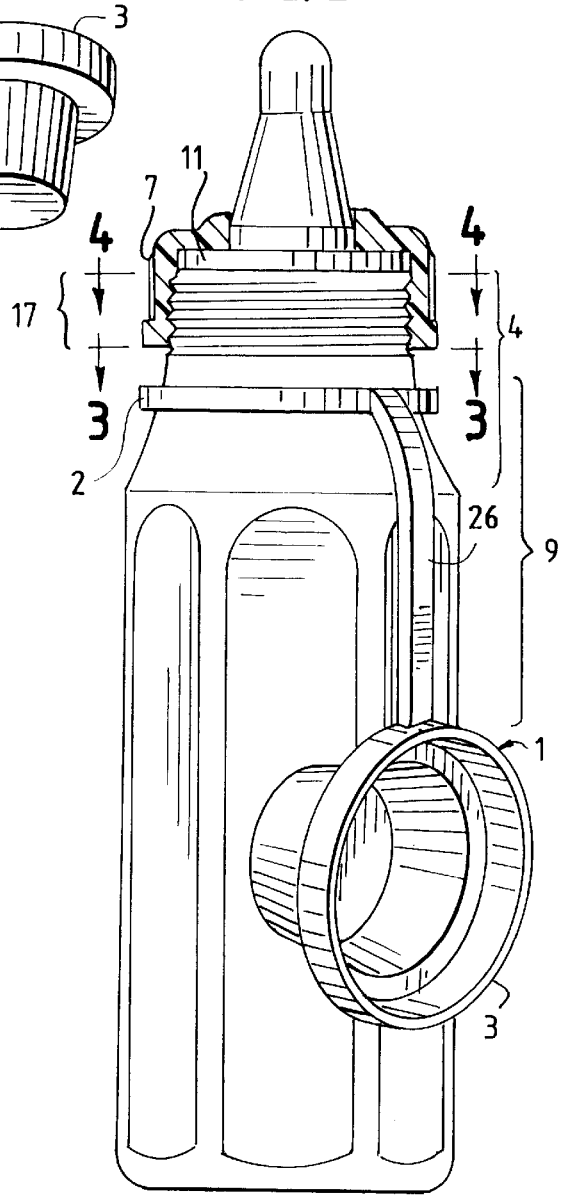
FIG. 2 is a side elevation view of the improved baby bottle nipple cover of the present invention with the ring of the improved baby bottle nipple cover disposed around the neck of the bottle with the cap removed from the nipple and secured by the attached collar.
Figure 3:
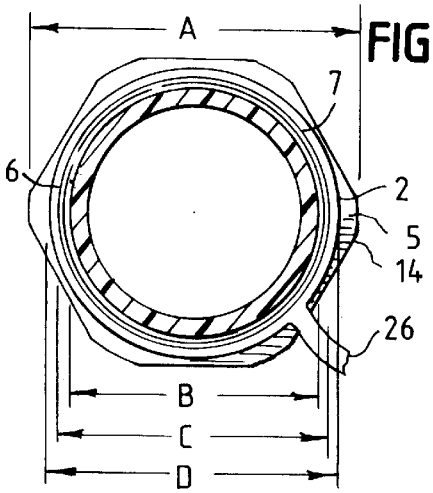
FIG. 3 is a cross sectional view of the improved baby bottle nipple cover of the present invention taken along the line 3—3 of FIG. 2 showing the outside diameter of the bottle, representing the shoulder for this bottle configuration, which is larger than the inside diameter of the ring, and further showing that the inside diameter of the ring is larger than the outside diameter of the threads.
Figure 4:
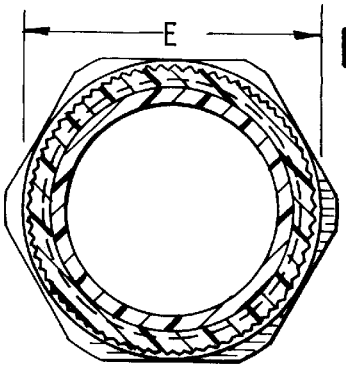
FIG. 4 is a cross sectional view of the improved bottle nipple cover of the present invention taken along the line 4—4 of FIG. 2 showing the outside diameter of the collar, and relative to FIG. 3, showing that the inside diameter of the ring is smaller then the outside diameter of the collar.

Without departing from the generality of the invention disclosed herein and without limiting the scope of the invention, the discussion that follows, will refer to the invention as depicted in the drawing.

The preferred embodiments of the apparatus depicted in the drawing comprise an improved baby bottle nipple cover 1 for use with a baby bottle 14 having an opening 15 and a nipple 10 that is sealingly securable to the opening by a collar 12, wherein the improvement comprises a cap 3 that is suitably sized to extend over the nipple 10, and means for retaining 9 the cap in proximity to the opening when the cap is removed from extending over the nipple independent of tethering said cap 3 to the collar 12. Preferably, the means for retaining the cap leaves the collar free to sealingly secure the nipple.

The improved baby bottle nipple cover 1 of this important invention is for use with a baby bottle that has a collar 12, an opening 15 circumscribed by a rim 16, an exterior surface of revolution 17 adjacent to the rim 16, a shoulder 5 extending radially outward from the exterior surface of revolution 17, means for engaging (shown in the drawing as threading) the collar 12 to the exterior surface of revolution, and a nipple 10 with a disk-shaped base 11 that can be sealingly secured to the opening 15 when the base is snugly disposed between the rim 16 and the collar 12. The improvement taught by this invention comprises a cap 3 that is suitably sized to extend over the nipple 10, and means for retaining 9 the cap in proximity to the opening while leaving the collar free for sealingly securing the base when the cap is removed from extending over the nipple. The means for retaining 9 comprises a yoke 18 disposed between the collar 12 and the shoulder 5.

In a preferred embodiment of the improved baby bottle nipple cover, the yoke 18 has an axial thickness which does not substantially exceed an axial distance between the collar 12 and the shoulder 5 when the base 11 is sealingly secured between the rim 16 and the collar 12.

In a preferred embodiment of the improved baby bottle nipple cover, the yoke has an axial thickness which is less than an axial distance between the collar and the shoulder when the base is sealingly secured between the rim and the collar.

Preferably, the yoke 18 is in the shape of a ring, as shown in FIGS. 1–9. Furthermore, the yoke may be comprised of a resilient compressible material with an uncompressed axial thickness which is greater than an axial distance between the collar and the shoulder when the base is sealingly secured between the rim and the collar and a compressed axial thickness corresponding to the axial distance between the collar and the shoulder when the base is sealingly secured between the rim and the collar.

Figure 10:
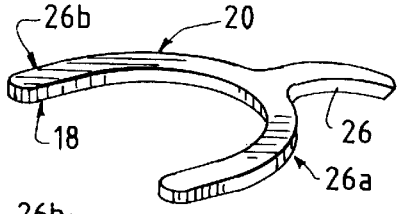
FIG. 10 is another preferred embodiment of the means for retaining of the improved bottle nipple cover of the present invention showing a c-shaped means for retaining.

In the preferred embodiment shown in FIG. 10, the yoke 18 is c-shaped 20 and may be comprised of a resilient compressible material with an uncompressed axial thickness which is greater than an axial distance between the collar and the shoulder when the base is sealingly secured between the rim and the collar and a compressed axial thickness corresponding to the axial distance between the collar and the shoulder when the base is sealingly secured between the rim and the collar.

Figure 11:
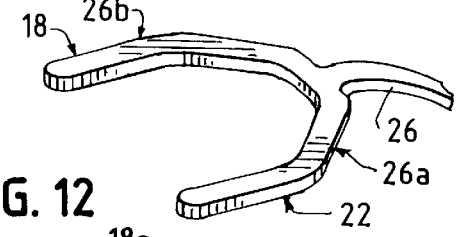
FIG. 11 is another preferred embodiment of the means for retaining of the improved bottle nipple cover of the present invention showing a u-shaped configuration.

Referring to FIG. 11, another preferred embodiment of the improved baby bottle nipple cover 1 is shown with the yoke 18 being unshaped 22. It may be comprised of a resilient compressible material with an uncompressed axial thickness which is greater than an axial distance between the collar and the shoulder when the base is sealingly secured between the rim and the collar and a compressed axial thickness corresponding to the axial distance between the collar and the shoulder when the base is sealingly secured between the rim and the collar.

Figure 12:
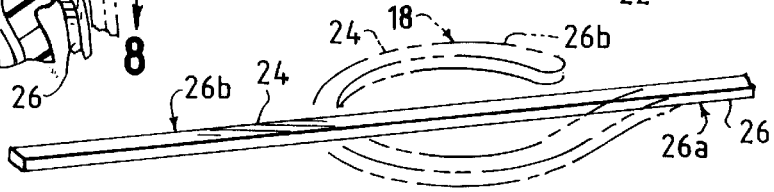
FIG. 12 is another preferred embodiment of the means for retaining of the improved bottle nipple cover of the present invention showing an elongated flexible strap that can be folded as shown in phantom to be disposed between the shoulder and the collar to retain the cap.

Referring to FIG. 12, another preferred embodiment of the means for retaining of the improved bottle nipple cover 1 of the present invention is shown comprising an elongated flexible strap 24 that can be folded, as shown in phantom, around the neck of the bottle between the shoulder and the collar to retain the cap.

As shown in the drawing, the yoke is connected to the cap. In a preferred embodiment, as shown in the various figures of the drawing, a tether 26 connects the yoke 18 to the cap 3. The yoke 18, tether 26, and cap 3 may be integrally connected. By using a flexibly rigid plastic, or other suitable material of construction, the yoke, tether, and cap can be comprised of one continuous piece of material.

Many baby bottles for which the improved baby bottle nipple cover may be used have a shoulder that comprises an annular projection with an outside diameter which is greater than an inside diameter of the yoke, and wherein the annular projection **5*a* is disposed at a spaced distance from the collar when the collar is sealingly securing the nipple. The means for retaining may comprise means for tethering 26*a* having a thickness that does not substantially exceed the spaced distance between the annular projection and the collar, when the collar is sealingly securing the nipple. As shown in FIGS. 1, and 10–12, the means for tethering 26*a* may have a variety of terminal ends 26*b* for attaching to the baby bottle, including a linear section that may be wrapped around the bottle, as shown in FIG. 12, between the annular projection and the collar and secured when the collar sealingly secures the nipple, a ring, a c-shaped end, a u-shaped end, or the like, as shown in FIGS. 1, 10, and 11**, respectively.

Figure 9:
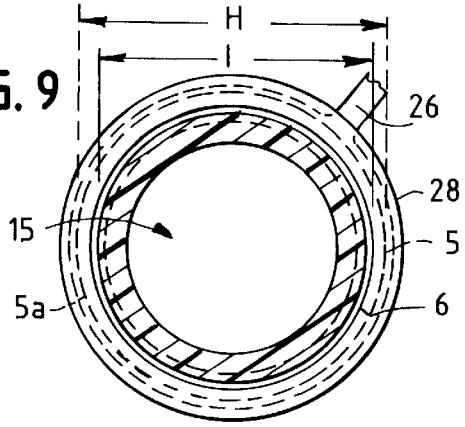
FIG. 9 is a cross sectional view of the improved baby bottle nipple cover of the present invention taken along the line 9—9 of FIG. 7 (with the phantom cap 3 removed) showing the outside diameter of the bead (i.e. shoulder) and the inside diameter of the ring of the improved bottle nipple cover of the present invention.
Figure 7:
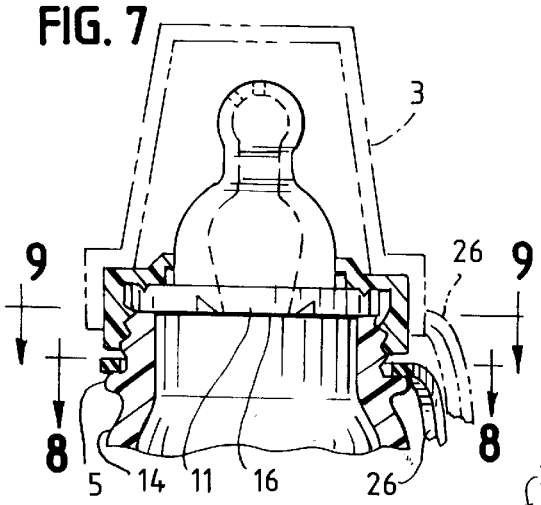
FIG. 7 is a cross sectional view of the improved baby bottle nipple cover of the present invention taken along the line 7—7 of FIG. 6 with the addition of the cap shown in hatched lines and particularly showing the base of the nipple sealingly secured on the rim of the bottle and with the means for retaining of the nipple cover disposed between the collar and the shoulder.

It will be appreciated that the internal diameter 6 of the ring 2 (shown as C in FIG. 3 and I in FIG. 9) is generally larger than the outside diameter of the threads 7 (shown as B in FIG. 3 and F in FIG. 9) for engaging the collar 12 to the bottle 14, that the internal diameter 6 of the ring 2 is generally smaller than the outside diameter of the collar 28 in FIG. 9 (shown as E in FIG. 4 ), and that the internal diameter 6 of the ring 2 is generally smaller than the outside diameter of the shoulder (H in FIG. 9).

Figure 5:
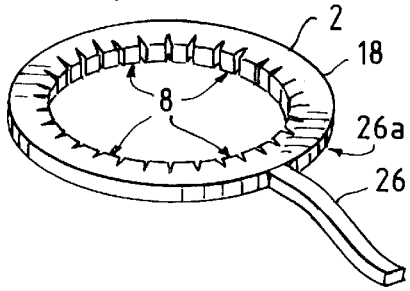
FIG. 5 is a preferred embodiment of the means for retaining of the improved bottle nipple cover of the present invention showing a ring with a plurality of inwardly directed fins.
Figure 6:
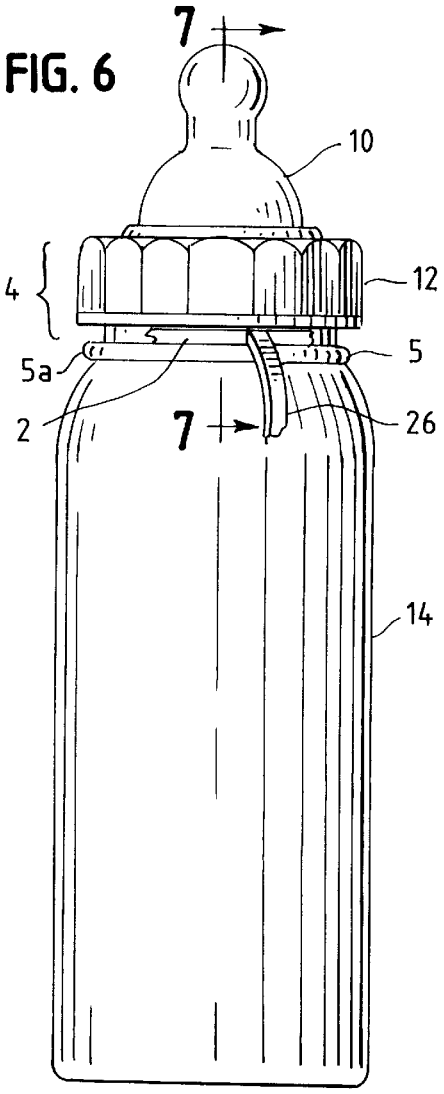
FIG. 6 is a partial side elevation view of a baby bottle showing the means for retaining of the baby bottle nipple cover being disposed between the collar and the shoulder of the bottle.
Figure 8:
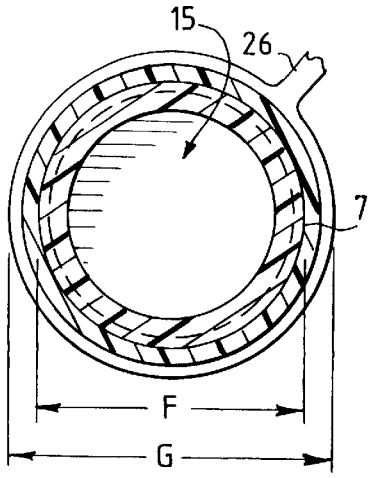
FIG. 8 is a cross sectional view of the improved baby bottle nipple cover of the present invention taken along the line 8—8 of FIG. 7 showing the outside diameter of the ring and the outside diameter of the threads of the bottle.

To accommodate variances in the diameter of the bottle neck, the yoke 18 may have an irregular inner surface, an example of which is shown in FIG. 5. In a preferred embodiment of the improved baby bottle nipple cover, the irregular inner surface comprises a plurality of flexibly rigid inwardly projecting fins 8 to facilitate adapting the yoke to the exterior surface of revolution of a variety of baby bottles having distinctive exterior surface of revolution diameters. Preferably, the yoke 18 has an axial thickness which does not substantially exceed an axial distance between the collar and the shoulder when the base is sealingly secured between the rim and the collar.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims. Those skilled in the art will appreciate that the conception upon which this disclosure is base, may readily be utilized as a basis for the designing of other structures, methods and systems for carrying out the several purposes of the present invention. It is important, therefore, that the claims be regarded as including such equivalent constructions insofar as they do not depart from the spirit and scop of the present invention.

My invention resides not in any one of these features per se, but rather in the particular combinations of some or all of them herein disclosed and claimed and it is distinguished from the prior art in these particular combinations of some or all of its structures for the functions specified.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An improved baby bottle nipple cover for use with a baby bottle having a collar, an opening circumscribed by a rim, an exterior surface of revolution adjacent to the rim, a shoulder extending radially outward from the exterior surface of revolution, means for engaging the collar to the exterior surface of revolution, and a nipple with a disk-shaped base that can be sealingly secured to the opening when the base is snugly disposed between the rim and the collar, wherein the improvement comprises a cap that is suitably sized to extend over the nipple, and means for retaining the cap in proximity to the opening while leaving said collar free for sealingly securing the base when the cap is removed from extending over the nipple, said means for retaining comprising a yoke disposed between the collar and the shoulder.

2. The improved baby bottle nipple cover of claim 1, wherein the yoke has an axial thickness which does not substantially exceed an axial distance between the collar and the shoulder when the base is sealingly secured between the rim and the collar.

3. The improved baby bottle nipple cover of claim 1, wherein the yoke has an axial thickness which is less than an axial distance between the collar and the shoulder when the base is sealingly secured between the rim and the collar.

4. The improved baby bottle nipple cover of claim 2, wherein the yoke is in the shape of a ring.

5. The improved baby bottle nipple cover of claim 4, wherein the yoke is comprised of a resilient compressible material with an uncompressed axial thickness which is greater than an axial distance between the collar and the shoulder when the base is sealingly secured between the rim and the collar and a compressed axial thickness corresponding to the axial distance between the collar and the shoulder when the base is sealingly secured between the rim and the collar.

6. The improved baby bottle nipple cover of claim 4, wherein the yoke has an irregular inner surface.

7. The improved baby bottle nipple cover of claim 6, wherein the irregular inner surface comprises a plurality of flexibly rigid inwardly projecting fins to facilitate adapting the yoke to the exterior surface of revolution of a variety of baby bottles having distinctive exterior surface of revolution diameters.

8. The improved baby bottle nipple cover of claim 1, wherein the yoke is c-shaped.

9. The improved baby bottle nipple cover of claim 8, wherein the yoke is comprised of a resilient compressible material with an uncompressed axial thickness which is greater than an axial distance between the collar and the shoulder when the base is sealingly secured between the rim and the collar and a compressed axial thickness corresponding to the axial distance between the collar and the shoulder when the base is sealingly secured between the rim and the collar.

10. The improved baby bottle nipple cover of claim 1, wherein the yoke is un-shaped.

11. The improved baby bottle nipple cover of claim 10, wherein the yoke is comprised of a resilient compressible material with an uncompressed axial thickness which is greater than an axial distance between the collar and the shoulder when the base is sealingly secured between the rim and the collar and a compressed axial thickness corresponding to the axial distance between the collar and the shoulder when the base is sealingly secured between the rim and the collar.

12. The improved baby bottle nipple cover of claim 1, wherein the yoke is connected to the cap.

13. The improved baby bottle nipple cover of claim 12, wherein the yoke comprises an elongated flexible strap that can be folded to be disposed around the neck of the bottle between the shoulder and the collar to retain the cap.

14. The improved baby bottle nipple cover of claim 12, wherein a tether connects the yoke to the cap.

15. The improved baby bottle nipple cover of claim 14, wherein the yoke, tether, and cap are integrally connected.

16. The improved baby bottle nipple cover of claim 15, wherein the yoke, tether, and cap are comprised of one continuous piece of material.

17. The improved baby bottle nipple cover of claim 1, wherein the shoulder comprises an annular projection with an outside diameter which is greater than an inside diameter of the yoke, said annular projection being disposed at a spaced distance from the collar when said collar is sealingly securing said nipple.

18. The improved baby bottle nipple cover of claim 17, wherein the means for retaining comprises means for tethering having a thickness that does not substantially exceed the spaced distance between the annular projection and the collar when said collar is sealingly securing said nipple.

* * * * *

UNITED STATES PATENT AND TRADEMARK OFFICE

CERTIFICATE OF CORRECTION

PATENT NO. : 6,302,286 B1
DATED : October 16, 2001
INVENTOR(S) : Ingrid Witherspoon It is certified that error appears in the above-identified patent and that said Letters Patent is hereby corrected as shown below:

Column 8,
Line 14, delete "un-shaped" and insert -- u-shaped. --

Signed and Sealed this

Nineteenth Day of March, 2002

*Attest:*

*Attesting Officer*

JAMES E. ROGAN
*Director of the United States Patent and Trademark Office*